US008906512B2

(12) United States Patent
Shoji et al.

(10) Patent No.: US 8,906,512 B2
(45) Date of Patent: Dec. 9, 2014

(54) METAL MATERIAL HAVING EXCELLENT CORROSION RESISTANCE

(75) Inventors: Hiromasa Shoji, Tokyo (JP); Noriyuki Kooka, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 336 days.

(21) Appl. No.: 12/737,893

(22) PCT Filed: Oct. 6, 2009

(86) PCT No.: PCT/JP2009/005190

§ 371 (c)(1),
(2), (4) Date: Feb. 24, 2011

(87) PCT Pub. No.: WO2010/041428

PCT Pub. Date: Apr. 15, 2010

(65) Prior Publication Data

US 2011/0177353 A1 Jul. 21, 2011

(30) Foreign Application Priority Data

Oct. 8, 2008 (JP) ..... 2008-262182
Oct. 8, 2008 (JP) ..... 2008-262216

(51) Int. Cl.

| | |
|---|---|
| ***B32B 15/04*** | (2006.01) |
| ***B05D 1/36*** | (2006.01) |
| ***C23C 22/83*** | (2006.01) |
| ***C23C 22/73*** | (2006.01) |

(52) U.S. Cl.

CPC ..... *C23C 22/83* (2013.01); *C23C 22/73* (2013.01)

USPC ..... 428/472; 428/457; 428/469

(58) Field of Classification Search

None

See application file for complete search history.

(56) References Cited

U.S. PATENT DOCUMENTS

| | | | | |
|---|---|---|---|---|
| 6,027,579 | A * | 2/2000 | Das et al. | 148/256 |
| 6,190,780 | B1 * | 2/2001 | Shoji et al. | 428/472 |
| 6,200,672 | B1 * | 3/2001 | Tadokoro et al. | 428/328 |
| 7,208,053 | B2 | 4/2007 | Wietzoreck et al. | |
| 7,393,578 | B2 * | 7/2008 | Ueda et al. | 428/141 |
| 7,416,774 | B2 * | 8/2008 | Ueda et al. | 428/141 |

FOREIGN PATENT DOCUMENTS

| | | |
|---|---|---|
| JP | 63-250470 | 10/1988 |
| JP | 09-031404 | 2/1997 |
| JP | 11-061431 | 3/1999 |
| JP | 2001-073168 A | 3/2001 |
| JP | 2002-012983 | 1/2002 |
| JP | 2002-264252 | 9/2002 |
| JP | 2003-055682 | 2/2003 |
| JP | 2003-191007 | 7/2003 |
| JP | 2003-526012 | 9/2003 |

(Continued)

OTHER PUBLICATIONS

Office Action dated Aug. 16, 2011 in Japanese Patent Application No. 2010-532811.

(Continued)

*Primary Examiner* — Vera Katz

(74) *Attorney, Agent, or Firm* — Kenyon & Kenyon LLP

(57) ABSTRACT

A metal material of the present invention is composed of an underlying metal and a phosphate compound-based film which is disposed on the surface of the underlying metal and has a surface part, in which the surface part of the phosphate compound-based film contains Zr.

11 Claims, 2 Drawing Sheets

(56) References Cited

FOREIGN PATENT DOCUMENTS

| | | | | |
|---|---|---|---|---|
| JP | 2003-293175 | | | 10/2003 |
| JP | 2003-342746 | A | | 12/2003 |
| JP | 2004-143475 | | | 5/2004 |
| JP | 2004-156081 | A | | 6/2004 |
| JP | 2004-204333 | A | | 7/2004 |
| JP | 2004-232082 | | | 8/2004 |
| JP | 2006-187789 | | | 7/2006 |
| JP | 2007-204847 | A | | 8/2007 |
| RU | 2051988 | | | 1/1996 |
| WO | WO 03/048416 | | | 6/2003 |
| WO | WO03/093533 | | * | 11/2003 |
| WO | WO 03/093533 | | | 11/2003 |
| WO | WO 2010/041428 | A1 | | 4/2010 |

OTHER PUBLICATIONS

International Search Report dated Nov. 2, 2009 issued in corresponding PCT Application No. PCT/JP2009/005190.

Russian Decision on Grant of Patent for Invention, dated Jul. 13, 2012, issued in corresponding Russian Application No. 2011108317, and a partial English translation thereof.

Official Inquiry, dated Feb. 28, 2012, issued in corresponding Japanese Application No. 2010-532811, and an English translation thereof.

Extended European Search Report dated Dec. 18, 2013 issued in corresponding EP Application No. 09818968.1.

* cited by examiner

METAL MATERIAL HAVING EXCELLENT CORROSION RESISTANCE

TECHNICAL FIELD

The present invention relates to a metal material having a protective film which has both lubricity and corrosion resistance.

This application is a national stage application of International Application No. PCT/JP2009/005190, filed Oct. 6, 2009, which claims priority to Japanese Patent Application No. 2008-262182, filed on Oct. 8, 2008, and Japanese Patent Application No. 2008-262216, filed on Oct. 8, 2008, the contents of which are incorporated herein by reference.

BACKGROUND ART

In a cold plastic process of metal materials such as a wire drawing process, a drawing process, a squeezing process and the like, a film for lubricating a processed material and a tool in order to prevent them from adhering to each other is generally formed on the surface of a processed metal material. Regarding a method for forming a film on the surface of a processed metal material, it is broadly classified into a method (I) which includes fixing a protective film material or a lubricant directly to the surface of the processed metal material, and a method (II) which includes forming a protective film on the surface of the processed metal material by applying a chemical conversion treatment and then forming a lubricative film on the upper layer of the protective film.

Since it is easy to apply the method (I) which includes adhering a protective film material or a lubricant directly to the surface of the processed metal material, it is advantageous in that there is substantially no need to manage a treatment liquid. However, a film formed according to the method (I) does not have sufficient adhesion to an underlying metal. In particular, in a haze process in which the surface of a processed metal material is in contact with a mold under strong surface pressure, the lubricative film may be detached from the metal material during hazing. In addition, in a process in which a processed metal material is greatly deformed, the lubricative film may not comply with the deformation of the processed metal material so that the lubricative film may be exfoliated and detached therefrom. In addition to a defect in the lubricative film, an extremely thin film portion and a film breakage portion may be readily generated even on a protective film formed on an underlying metal. Therefore, the film formed according to the method (I) may not sufficiently exhibit its function as a protective film. For that reason, in a cold plastic process such as a metal wire drawing process, a drawing process, and the like, the method (II) is frequently applied which includes forming a protective film by applying a chemical conversion treatment and then forming a lubricative film on the upper layer of the protective film in order to obtain a film having high lubricity and strong adhesion.

A phosphate compound-based film and an oxalate compound film are known as the protective films formed by a chemical conversion treatment. These protective films have high adhesion to the surface of a processed metal material. However, the protective films have insufficient corrosion resistance. As a result, corrosion and rust are generated on a metal material due to environmental changes occurring when transporting the metal material, thereby considerably deteriorating a product value. Therefore, the protective films are not preferable to use from a viewpoint of quality. For that reason, it is strongly required to have a film having both excellent corrosion resistance and lubricity sustainable in severe processes, and a film for solving the above-mentioned problems and a method for forming the film have been proposed.

When a crystalline inorganic compound film is used, a base metal may be exposed to the outside through a gap between the crystals. Therefore, the exposed portion of the metal is readily rusted and the corrosion resistance deteriorates. In Patent Document 1, a technique is proposed in which a mixed film formed by mixing a crystalline inorganic compound, such as sulfate, and an amorphous inorganic material, such as silicate, is used as a protective film as a support, and improvement in function as a protective film is made by applying the technique. However, the amorphous inorganic material film, which is the outer surface, has poor adhesion to a lubricative film. Therefore, in Patent Document 1, a method is proposed which includes setting the surface roughness in the amorphous inorganic material film, which is the outer surface, to 2 to 10 μm to increase retentive property and adhesion of a lubricative film. However, it is impossible to obtain the adhesion and lubricity required for severe processes such as a wire drawing process, a drawing process, a squeezing process and the like.

In Patent Document 2, a protective film is disclosed which is obtained according to a simple method which includes mixing specific alkaline silicate with water. Alkaline silicate exhibits satisfactory corrosion resistance as a protective film. However, when a lubricative component is applied onto the protective film, adhesion of the protective film to the lubricative film is insufficient, thereby deteriorating lubricity. In addition, when a lubricative component is contained in the film, it is impossible for the film to have both lubricity and protective property (corrosion resistance) and both properties deteriorate.

In Patent Document 3, as a method for producing a satisfactory film with anti-rust and anti-corrosion properties, the present inventors have proposed a method for producing an oxide film or a hydroxide film of a metal, which includes applying a liquid-phase precipitation method in which a fluorine compound aqueous solution is applied on the surface of an underlying metal. In Patent Document 4, the present inventors have proposed forming a film made of an oxyacid compound or an oxyacid hydrogen compound, which is an element in an IVA group, on the surface of an underlying metal as a satisfactory film for anti-rust and anti-corrosion.

According to the method described in Patent Document 3, it is possible to obtain a zirconium oxide film which exhibits corrosion resistance because of the barrier property. However, when a metal material is subjected to severe processes such as a wire drawing process, a drawing process, a squeezing process and the like, the film may not sufficiently exhibit excellent corrosion resistance. On the other hand, according to the method described in Patent Document 4, it is possible to obtain both process compliance of an oxyacid compound or an oxyacid hydrogen compound, which is an element in an IVA group, such as zirconium, and corrosion resistance due to the barrier property. However, since a structure of the film is simple and is not a laminated structure having an inclined structure, the film may not exhibit sufficient corrosion resistance under corrosive conditions containing a complicated corrosion factor and a strong corrosion factor.

PRIOR ART DOCUMENT

Patent Document

[Patent Document 1] Japanese Unexamined Patent Application, First Publication No. 2003-191007

[Patent Document 2] Japanese Unexamined Patent Application, First Publication No. 2003-55682

[Patent Document 3] International Publication No. WO2003/048416

[Patent Document 4] Japanese Unexamined Patent Application, First Publication No. H11-61431

DISCLOSURE OF THE INVENTION

Problems to be Solved by the Invention

The present invention provides a metal material having a protective film which has a strong protection function exhibiting excellent corrosion resistance and anti-rust property even under adverse conditions such as environmental changes occurring when transporting a metal material, and may be a sufficient support (carrier) to form a lubricative film sustainable in severe processes.

Means for Solving the Problems

The present invention is made for solving the above-mentioned problems and the details are as follows.

(1) A first aspect of the present invention is a metal material having an underlying metal and a phosphate compound-based film, which is disposed on the surface of the underlying metal and has a surface part, in which the surface part of the phosphate compound-based film contains Zr.

(2) Regarding the metal material according to (1), the phosphate compound-based film may contain Zr in an amount of equal to or more than 1 $mg/m^2$.

(3) Regarding the metal materials according to (1) and (2), the phosphate compound-based film may contain zinc.

(4) Regarding the metal materials according to (1) to (3), a phosphate compound of the phosphate compound-based film may be mainly zinc phosphate.

(5) Regarding the metal materials according to (1) to (4), equal to or more than 75% by mass of Zr contained in the phosphate compound-based film may exist in an area from the surface to a depth of 50% in the thickness direction of the phosphate compound-based film.

(6) Regarding the metal materials according to (1) to (5), the phosphate compound-based film may include plural layers having at least one layer containing Zr and at least one layer containing no Zr, and the uppermost layer of the plural layers may contain the largest amount of Zr.

(7) Regarding the metal materials according to (1) to (6), the total adhesion amount of the phosphate compound-based film may be equal to or more than 1 $g/m^2$ and equal to or less than 20 $g/m^2$ in terms of P.

(8) The metal materials according to (1) to (7) may further include a lubricative film disposed on the Zr-based phosphate compound film.

(9) Regarding the metal materials according to (1) to (8), the main component of the surface of the underlying metal may be iron.

(10) A second aspect of the present invention is a metal material having an underlying metal; a phosphate compound-based film disposed on the surface of the underlying metal; and a Zr-based phosphate compound film disposed on the surface of the phosphate compound-based film.

(11) Regarding the metal material according to (10), the adhesion amount of the Zr-based phosphate compound film may be equal to or more than 1 $mg/m^2$ and equal to or less than 200 $mg/m^2$ in terms of Zr.

(12) Regarding the metal materials according to (10) and (11), the adhesion amount of the phosphate compound-based film may be equal to or more than 1 $g/m^2$ and equal to or less than 20 $g/m^2$ in terms of P.

(13) Regarding the metal materials according to (10) to (12), the phosphate compound-based film may be a zinc phosphate film.

(14) The metal materials according to (10) to (13) may further include a lubricative film disposed on the Zr-based phosphate compound film.

(15) Regarding the metal materials according to (10) to (14), the main component of the surface of the underlying metal may be iron.

(16) A third aspect of the present invention is a method for producing a metal material, which includes forming a zinc phosphate-based film on the surface of an underlying metal; and dispersing a Zr-based phosphate compound on an upper layer part in the zinc phosphate-based film by dipping the underlying metal on which the zinc phosphate-based film is formed in a treatment liquid prepared by mixing and dissolving zinc phosphate and a Zr-based compound, followed by keeping the mixture warm with heating.

(17) Regarding the method for producing a metal material according to (16), the molar ratio of Zr to P (Zr ion/P ion) in the treatment liquid may be 0.0003 to 0.09.

(18) Regarding the methods for producing a metal material according to (16) and (17), the molar concentration of a Zr ion in the treatment liquid may be 0.001 mol/L to 0.1 mol/L.

(19) Regarding the methods for producing a metal material according to (16) to (18), the dipping of the underlying metal may be carried out for 1 to 20 minutes.

(20) Regarding the methods for producing a metal material according to (16) to (19), the temperature of the treatment liquid may be 40 to 90° C.

(21) The methods for producing a metal material according to (16) to (20) may include forming a soapy layer on the surface of the metal material by dipping the metal material in a sodium stearate solution or a lime soap solution.

(22) A fourth embodiment of the present invention is a method for producing a metal material, which includes forming a zinc phosphate-based film on the surface of an underlying metal; and forming a Zr-based phosphate compound film on the zinc phosphate-based film by dipping the underlying metal on which the zinc phosphate-based film is formed in a treatment liquid prepared by adding a Zr-based compound to phosphoric acid, followed by mixing, dissolving and keeping the mixture warm with heating.

(23) Regarding the method for producing a metal material according to (22), the molar ratio of Zr to P (Zr ion/P ion) in the treatment liquid may be 0.1 to 1,000.

(24) Regarding the methods for producing a metal material according to (22) and (23), the molar concentration of a Zr ion in the treatment liquid may be 0.001 mol/L to 1 mol/L.

(25) Regarding the methods for producing a metal material according to (22) to (24), the dipping of the underlying metal may be carried out for 1 to 20 minutes.

(26) Regarding the methods for producing a metal material according to (22) to (25), the temperature of the treatment liquid may be 40 to 90° C.

(27) The methods for producing a metal material according to (22) to (26) may include forming a soapy layer on the surface of the metal material by dipping the metal material in a sodium stearate solution or a lime soap solution.

Effects of the Invention

According to the first aspect of the present invention described in (1), when a phosphate compound-based film containing Zr in a surface part thereof is formed on the surface of an underlying metal, it is possible to obtain a metal material having excellent corrosion resistance.

According to the inventions described in (2) to (7), it is possible to obtain a metal material having further excellent and stable corrosion resistance.

According to the invention described in (8), by forming a lubricative film on a phosphate compound-based film containing Zr, a metal material having lubricity and excellent corrosion resistance can be obtained.

According to the invention described in (9), it is possible to obtain a metal material capable of exhibiting the above-mentioned effects at a low cost when compared to a case of using a plated metal or the like as an underlying metal.

According to the invention described in (10), by disposing a Zr-based phosphate compound film on the surface of a phosphate compound-based film, it is possible to obtain excellent corrosion resistance.

According to the inventions described in (11) to (13), it is possible to obtain a metal material having further excellent and stable corrosion resistance.

According to the invention described in (14), by forming a lubricative film on a Zr-based phosphate compound film, it is possible to obtain a metal material having lubricity and excellent corrosion resistance.

According to the invention described in (15), it is possible to obtain a metal material capable of exhibiting the above-mentioned effects at a cost low cost when compared to a case of using a plated metal or the like as an underlying metal.

According to the inventions described in (16) to (27), it is possible to produce a metal material having excellent corrosion resistance. In particular, according to the inventions described in (21) and (27), it is possible to produce a metal material having both corrosion resistance and lubricity.

As mentioned above, according to the present invention, it is possible to form a strong protective film having high corrosion resistance while sustaining existing lubricity without greatly changing the usual materials and processes.

As a result, stable processability during a wire drawing process and a drawing process of a metal material is secured and also the metal material is able to sustain sufficient properties as a protective film after the completion of the process. Therefore, it is possible to obtain stable quality without incurring corrosion and rust even under adverse conditions such as environmental changes occurring in transit.

EMBODIMENTS OF THE INVENTION

Hereinafter, a first embodiment of the present invention will be described with reference to FIG. 1.

As a phosphate compound containing Zr (zirconium), which exhibits excellent corrosion resistance as a film formed on an underlying metal, there exist various compounds and configurations. Among them, the present inventors have found that a film mainly composed of a Zr-based phosphate compound for example, represented by zirconium phosphate and zirconium hydrogen phosphate has excellent barrier property.

There are various methods for forming the Zr-based phosphate compound film. However, for example, it is possible to form a film by making a treatment liquid, in which a Zr-based compound (for example, $(NH_4)_2ZrF_6$ and $ZrO(NO_3)_2$ are representative) and phosphoric acid are mixed and dissolved, to contact the surface of an underlying metal.

The thus obtained Zr-based phosphate compound film has excellent bather property. However, when the Zr-based phosphate compound film is used alone, the film may have insufficient corrosion resistance. In order to improve the corrosion resistance, increasing the adhesion amount of the Zr-based phosphate compound film is considered. However, in that case, processability and strength of the Zr-based phosphate compound film deteriorate and strength of adhesion to a substrate also deteriorates. Therefore, it is impossible to obtain the required processability and corrosion resistance after the completion of the process. In order to solve the problems, in this embodiment, a Zr-based phosphate compound is used in combination with the other phosphate compound-based films. As a result, it is possible to exhibit excellent properties such as adhesion to a lubricative film under severe processes and corrosion resistance after the completion of the process, as well as excellent corrosion resistance and processability.

Figure 1:
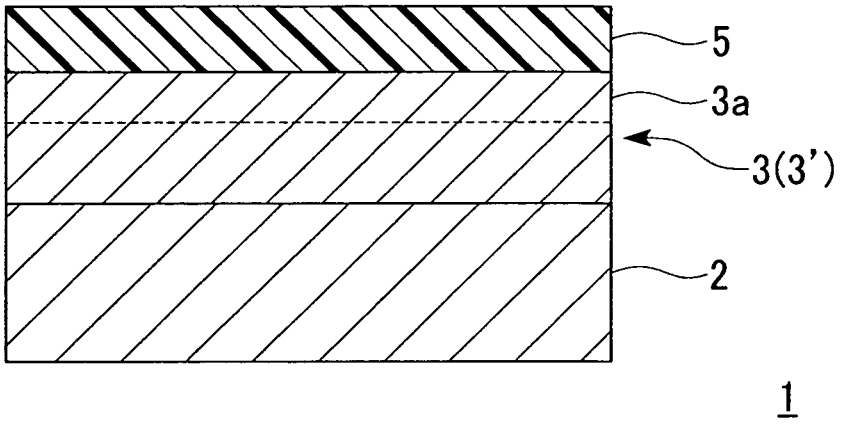
FIG. 1 is a view illustrating a film structure of a metal material according to the first embodiment of the present invention.

FIG. 1 is a view illustrating a film structure of a metal material according to a first embodiment of the present invention. For convenience, in FIG. 1, a film structure is shown in which a plate-like underlying metal 2 is used as a substrate. However, a wire rod material and a rod material are applied as the substrate in the present invention. According to the embodiment, as shown in FIG. 1, a phosphate compound-based film 3 containing a Zr-based phosphate compound 3*a* on a surface part thereof is disposed on the underlying metal 2, which is the substrate. On the phosphate compound-based film 3 containing the Zr-based phosphate compound 3*a*, a lubricative film 5 may be disposed. Examples of the underlying metal 2, which is the substrate, include a rolled steel material of which the main component is iron, such as cold-rolled steel and a wire rod; a surface-treated steel material such as a plated steel material (a hot-dip galvanized steel material, an electrogalvanized steel material, a hot-dip Zn—Al—Mg alloy-coated steel material and the like); and other materials besides a steel material such as an aluminum material and a magnesium material. According to the present invention, metals containing Fe in an amount of 50% or more are defined as metals of which the main component is iron. According to this embodiment, a film structure in which the Zr-based phosphate compound 3*a* is dispersed in the surface part of the phosphate compound-based film 3 obtained by a common chemical conversion treatment is employed. Therefore, there is no need to greatly change equipment and processes commonly used in the chemical conversion treatment and there is no high increase in cost. In addition, since the present invention employs the above-mentioned film structure, the phosphate compound-based film 3 has a great affinity for the Zr-based phosphate compound 3*a*. Accordingly, according to the film structure of this embodiment, it is possible for the phosphate compound-based film 3 to achieve excellent corrosion resistance due to the Zr-based phosphate compound 3*a* while ensuring great adhesion. Therefore, it is possible to exhibit the above-mentioned excellent properties.

Herein, the phosphate compound-based film 3, which is the matrix of the film, indicates a film in which a phosphate compound (including a phosphate hydrogen compound (the same will be applied hereinafter)) is the main component. The phosphate compound may be plural kinds or one kind. In addition, the film in which a phosphate compound is the main component may be a film made of substantially 100% of a phosphate compound. Examples of the phosphate compound to be used include zinc phosphate, zinc-ferrous phosphate, calcium phosphate, and iron phosphate depending on a kind of a salt thereof. However, it is preferable to use zinc phosphate or zinc-ferrous phosphate. It should be noted that the phosphate compound-based film containing manganese or nickel tends to be blackened in comparison with the film which does not contain them. Accordingly, it is preferable to mix only the unavoidable (minimal) amount thereof. Regarding the blackening, though it is presumed that it is because of a formation of a microcrystal, the detailed mechanism and effects of elements other than manganese and nickel are unknown.

The film formed using zinc phosphate is generally formed by subjecting the surface of an underlying metal such as a steel material to a chemical conversion treatment. Therefore, the film formed using zinc phosphate has excellent adhesion to the underlying metal and the treatment temperature is relatively low. Accordingly, the zinc phosphate film is widely used as a protective film of a metal material. This embodiment will be described below with reference to an example where a zinc phosphate-based film 3' is used as the phosphate compound-based film 3, which is the matrix of the film.

At first, the zinc phosphate-based film 3' is formed in advance on the underlying metal 2, which is the substrate. In the zinc phosphate-based film 3', zinc phosphate, zinc-ferrous phosphate and the like may be contained. It is also possible to contain other metal elements in the zinc phosphate-based film 3' within the range of not having a detrimental effect on properties and appearances. Regarding metal species contained in the zinc phosphate-based film 3', it is preferable that the standard electrode potential of the metal species is equal to or lower than the standard electrode potential of the metal component which mainly constitutes the substrate. When iron and steel are the underlying metal 2, zinc and aluminum, which have a lower standard electrode potential than that of iron, do not deteriorate corrosion resistance of the substrate, but metal species such as copper and silver having higher standard electrode potential than that of iron may deteriorate corrosion resistance of the underlying metal 2 because a local cell is formed when the substrate is not sufficiently covered with these metals. In addition, as mentioned above, it is preferable that manganese and nickel not be contained.

The formation of the zinc phosphate-based film 3' may be carried out by a chemical conversion treatment in which a zinc phosphate treatment liquid (a first treatment liquid) is used, which is a so-called bonderite treatment. As for treatment conditions, commonly known conditions may be applied. In addition, the adhesion amount of the zinc phosphate-based film 3' may be equal to the adhesion amount for a zinc phosphate-based film treatment of the surface of the common steel material. In other words, the adhesion amount of the zinc phosphate-based film 3', throughout the zinc phosphate-based film 3', is preferably 1 to 20 $g/m^2$ and more preferably 1 to 10 $g/m^2$ in terms of P. When the adhesion amount of the zinc phosphate-based film 3' is smaller than 1 $g/m^2$, the coverage of the zinc phosphate-based film 3' on the underlying metal 2 becomes insufficient so that the properties of the film may not be sufficiently verified. In addition, when the adhesion amount of the zinc phosphate-based film 3' is larger than 20 $g/m^2$, a balance of the film and the Zr amount to be added afterwards deteriorates so that the film may have insufficient corrosion resistance.

Next, a Zr-based phosphate compound **3*a* (zirconium phosphate and zirconium hydrogen phosphate) is dispersed in the surface part of the zinc phosphate-based film 3'. In order to disperse the Zr-based phosphate compound 3*a*, for example, a treatment is carried out using a treatment liquid (a second treatment liquid) prepared by adding a Zr-based compound ($(NH_4)_2ZrF_6$, $ZrO(NO_3)_2$ and the like) to the zinc phosphate treatment liquid, which is a base, followed by mixing, dissolving and keeping the mixture warm with heating at around 40° C. to 90° C., more preferably around 70° C. to 90° C., and further preferably around 80° C. It is preferable that the molar ratio of Zr to P (Zr ion/P ion) in the treatment liquid be 0.0003 to 0.09. It is preferable that the molar concentration of a Zr ion in the treatment liquid be 0.001 mol/L to 0.1 mol/L. According to this embodiment, as a treatment method for containing the Zr-based phosphate compound 3*a* in the surface part of the zinc phosphate-based film 3', there is exemplified a method which includes dipping the underlying metal 2 on which the zinc phosphate-based film 3' is formed in advance in the second treatment liquid for about 1 to 20 minutes, more preferably about 1 to 5 minutes, and further preferably about 3 to 4 minutes. Then, it is possible to form the zinc phosphate-based film 3' in which the Zr-based phosphate compound 3*a*** is dispersed and contained in the surface part thereof.

In order to have an effect on film formation efficiency and uniformity, it is permissible to appropriately stir the treatment liquid and oscillate the substrate.

As a result, it is possible to obtain the zinc phosphate-based film 3' in which the Zr-based phosphate compound **3*a* is dispersed and contained in the surface part thereof, which covers a defective part in an area deeper than the surface part of the zinc phosphate-based film 3'. Therefore, the barrier property of the film is increased and the Zr-based phosphate compound 3*a* is dispersed and then exists in the upper layer part of the zinc phosphate-based film 3' while zinc phosphate is a matrix component of the film. Accordingly, since corrosion resistance of the Zr-based phosphate compound 3*a*** such as the barrier property is greatly improved, the function of the film as a protective film having excellent corrosion resistance may be improved.

The above-mentioned is an example of a double-layered film. However, it is possible to obtain a film structure having plural layers by repeating the treatment. Further, by changing the concentration of the treatment liquid and a dipping period, the amount of phosphorus (P) and zirconium (Zr) to be contained in each layer can be varied.

In addition, it is permissible to form a zinc phosphate-based film containing the Zr-based phosphate compound **3*a* directly on the underlying metal 2 by dipping the underlying metal 2** in a treatment liquid in which the Zr-based compound is added to a zinc phosphate treatment liquid.

In addition, it is possible to form a so-called gradient layer in which the Zr content is continuously increased in the outer layer direction by continuously varying the Zr concentration in a treatment liquid (a second treatment liquid) in which the Zr-based phosphate compound **3*a*** is added to a zinc phosphate treatment liquid.

The above-mentioned is an example of obtaining the phosphate compound-based film 3 in which the Zr-based phosphate compound **3*a*** is dispersed in the surface part thereof. The other methods except the above-mentioned methods may be employed.

As mentioned above, it is possible to obtain the phosphate compound-based film 3 in which Zr is contained in the surface part thereof. It is preferable that Zr, contained throughout the phosphate compound-based film 3 in the amount of 60% or more and more preferably 75% or more, exist in an area from the surface of the phosphate compound-based film 3 to a depth of 50% in the thickness direction of the phosphate compound-based film 3. When Zr exists in the amount of less than 60%, sufficient effects are not shown. When 60% or more of Zr exists, a particular effect may be shown, and when 75% or more of Zr exists, stable effects are exhibited. Though it is not clearly identified, it is presumed that this tendency may reflect a two-dimensional distribution of Zr in a surface layer. According to the present invention, an area where the P concentration identified by carrying out an element analysis in the depth direction of the film in accordance with glow discharge optical emission spectrometry (GDS) becomes ½ of the P concentration in the outermost surface is defined based on an area from the surface of the phosphate compound-based film 3 to a depth of 50% in the thickness direction of the phosphate compound-based film 3. Regarding the existing amount of Zr, an element analysis in the depth direction of the film is carried out in accordance with GDS in the same manner as above, and the Zr content throughout the film and the amount of Zr contained in the area from the surface to a depth of 50% are measured and calculated. However, when carrying out the GDS analysis, the emission intensity of samples in the outermost surface layer part may be unstable. Therefore, for the P concentration in the outermost surface and the analysis value of Zr used in the present application, a value calculated by eliminating data from such an unstable part is applied. In addition, GDS measurement conditions are set as high-frequency electricity of 35 W, under 600 Pa in an argon atmosphere, analysis area of ϕ4 mm, a measuring time of 100 seconds, and a sampling time of 0.05 sec/point.

Though it depends on film forming conditions, the amount of the Zr-based phosphate compound 3*a* required to improve a corrosion resistance effect due to the barrier property of the Zr-based phosphate compound 3*a* is preferably equal to or higher than 1 $mg/m^2$ in terms of the adhesion amount of Zr. When the amount of the Zr-based phosphate compound 3*a* is equal to or more than 10 $mg/m^2$, it is possible to expect to have the satisfactory corrosion resistance required for general use. When the amount of the Zr-based phosphate compound 3*a* is equal to or more than 20 $mg/m^2$, it is possible to obtain sufficient corrosion resistance even under adverse conditions. In addition, when the film is thickened in the same manner as in the above-mentioned independent film, the adhesion of the film to the underlying metal 2, which is the substrate, may deteriorate. Therefore, it is preferable to set the upper limit to 200 $mg/m^2$.

It is permissible to form a lubricative film 5, which becomes the outermost layer, after the completion of formation of the phosphate compound-based film 3 containing the Zr-based phosphate compound 3*a* in the surface layer thereof. For the lubricative film 5, a generally used method for forming a lubricative film itself may be employed. Therefore, there is no need to set specific treatment conditions and it is possible to obtain the same lubricity and processability as usual. To be specific, the lubricative film 5, for example, may be a lubricative film formed by a lube treatment. To be more specific, a metal-soapy layer and an unreacted metal and soapy layer may be formed on the surface of a metal material by dipping the metal material in a sodium stearate solution. When the metal material is dipped in a lime soap solution, only an (unreacted) soapy layer is formed.

As mentioned above, it is possible to obtain a protective film which has the usual lubricity and significantly increased corrosion resistance.

Hereinafter, a second embodiment of the present invention will be described with reference to FIG. 2.

As a phosphate compound containing Zr (zirconium), which exhibits excellent corrosion resistance as a film formed on an underlying metal, there exist various compounds and configurations. Among them, a film mainly composed of a Zr-based phosphate compound for example, represented by zirconium phosphate and zirconium hydrogen phosphate has excellent barrier property.

There are various methods for forming the Zr-based phosphate compound film. However, for example, it is possible to form a film by making a treatment liquid, in which a Zr-based compound (for example, $(NH_4)_2ZrF_6$ or $ZrO(NO_3)_2$ are representative) and phosphoric acid are mixed and dissolved, to contact with the surface of an underlying metal.

The thus obtained Zr-based phosphate compound film has excellent barrier property. However, when the adhesion amount of the Zr-based phosphate compound film by itself is in the range of 1 $mg/m^2$ to 20 $mg/m^2$, which is the usual amount, the film may exhibit insufficient corrosion resistance due to the effects of pinholes and locally thin film portions. As a solution for improving the corrosion resistance, it is considered that when the adhesion amount of a Zr-based phosphate compound film is increased, the defects in the film may be covered. However, in that case, processability and strength of the Zr-based phosphate compound film deteriorate and strength of adhesion to a substrate also deteriorates. Therefore, it is impossible to obtain the required processability and corrosion resistance after the completion of the process. In order to solve the problems, in this embodiment, a Zr-based phosphate compound is used in combination with the other phosphate compound-based films. As a result, it is possible to exhibit excellent properties such as adhesion to a lubricative film under severe processes and corrosion resistance after the completion of the process as well as excellent corrosion resistance and processability.

Figure 2:
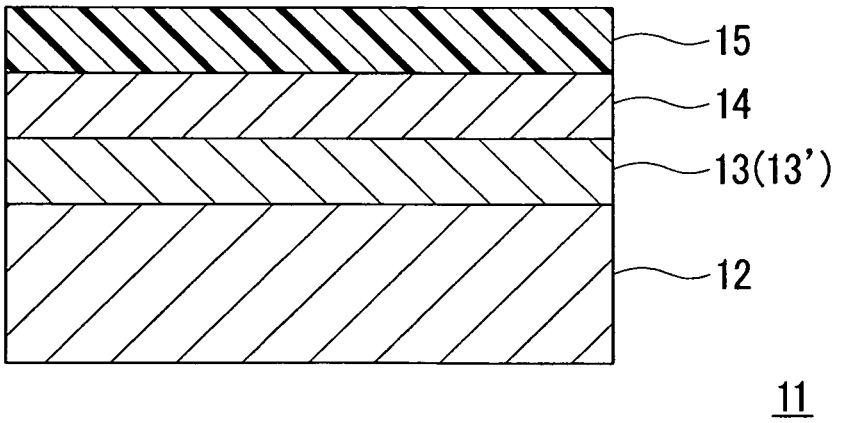
FIG. 2 is a view illustrating a film structure of a metal material according to the second embodiment of the present invention.

FIG. 2 is a view illustrating a film structure of a metal material according to a second embodiment of the present invention. For convenience, in FIG. 2, a film structure is shown in which a plate-like underlying metal 12 is used as a substrate. However, a wire rod material and a rod material are applied as the substrate in the present invention. According to the embodiment, as shown in FIG. 2, a phosphate compound-based film 13, which is an under layer, is disposed on the underlying metal 12, which is the substrate. On the phosphate compound-based film 13, a Zr-based phosphate compound film 14, which is an upper layer, is further disposed. On the Zr-based phosphate compound film 14, a lubricative film 15 may be disposed. Examples of the underlying metal 12, which is the substrate, include a rolled steel material of which the main component is iron, such as cold-rolled steel and a wire rod; a surface-treated steel material such as a plated steel material (a hot-dip galvanized steel material, an electrogalvanized steel material, a hot-dip Zn—Al—Mg alloy-coated steel material and the like); and other materials besides a steel material such as an aluminum material and a magnesium material. According to the present invention, metals containing Fe in an amount of 50% or more are defined as metals of which the main component is iron. According to this embodiment, a film structure in which the Zr-based phosphate compound film 14 is disposed on the phosphate compound-based film 13 obtained by a common chemical conversion treatment is employed. Therefore, there is no need to greatly change equipment and processes commonly used in the chemical conversion treatment and there is no high increase in cost. In addition, since each film which contains the same phosphate compound is laminated with each other, the interface thereof has a great affinity for each other. Accordingly, according to the film structure of this embodiment, it is possible for the phosphate compound-based film 13 to achieve excellent corrosion resistance due to the Zr-based phosphate compound film 14 while ensuring great adhesion to the underlying metal 12. Therefore, it is possible to exhibit the above-mentioned excellent properties.

Herein, the phosphate compound-based film 13 which is the under layer film indicates a film in which a phosphate compound (including a phosphate hydrogen compound (the same will be applied hereinafter)) is the main component. The phosphate compound may be plural kinds or one kind. It should be noted that the film in which a phosphate compound is the main component may be a film made of substantially 100% of a phosphate compound. Examples of the phosphate compound to be used include zinc phosphate, zinc-ferrous phosphate, calcium phosphate, and iron phosphate depending on a kind of a salt thereof. However, it is preferable to use zinc phosphate or zinc-ferrous phosphate. In addition, the phosphate compound-based film containing manganese and nickel tends to be blackened in comparison with the film which does not contain them. Accordingly, it is preferable to mix only the unavoidable (minimal) amount thereof. Regarding the blackening, it is presumed that it is because of the formation of microcrystals. However, the detailed mechanism and effects of elements other than manganese and nickel are unknown.

The film formed using zinc phosphate is generally formed by subjecting the surface of an underlying metal such as a steel material to a chemical conversion treatment. Therefore, the film formed using zinc phosphate has excellent adhesion to the underlying metal and the treatment temperature is relatively low. Accordingly, the zinc phosphate film is widely used as a protective film of a metal material. This embodiment will be described below with reference to an example where a zinc phosphate-based film 13' is used as the phosphate compound-based film 13, which is the matrix of the film.

At first, the zinc phosphate-based film 13', which is the under layer, is formed in advance on a metal material 11, which is a substrate. In the zinc phosphate-based film 13', zinc phosphate, zinc-ferrous phosphate and the like may be contained. It is also possible to contain the other metal elements in the zinc phosphate-based film 13' within the range of not having a detrimental effect on properties and appearances. Regarding metal species contained in the zinc phosphate-based film 13', it is preferable that the standard electrode potential of the metal species be equal to or lower than the standard electrode potential of the metal component which mainly constitutes the substrate. When iron and steel are the underlying metal 12, zinc and aluminum, which have a lower standard electrode potential than that of iron, do not deteriorate corrosion resistance of the substrate, but the metal species such as copper and silver having a higher standard electrode potential than that of iron may deteriorate corrosion resistance of the underlying metal 12 because a local cell is formed when the substrate is not sufficiently covered with these metals. In addition, as mentioned above, it is preferable that manganese and nickel not be contained.

The formation of the zinc phosphate-based film 13' may be carried out by a chemical conversion treatment in which a zinc phosphate treatment liquid (a first treatment liquid) is used, which is a so-called bonderite treatment. As for treatment conditions, commonly known conditions may be applied. In addition, the adhesion amount of the zinc phosphate-based film 13' may be the same adhesion amount for a zinc phosphate-based film treatment of the surface of the general steel material. In other words, the adhesion amount of the zinc phosphate-based film 13', throughout the zinc phosphate-based film 13', is preferably 1 to 20 g/m$^2$ and more preferably 1 to 10 g/m$^2$ in terms of P. When the adhesion amount of the zinc phosphate-based film 13' is smaller than 1 g/m$^2$, the coverage of the zinc phosphate-based film 13' on the underlying metal 12 becomes insufficient so that the properties of the film may not be sufficiently achieved. In addition, when the adhesion amount of the zinc phosphate-based film 13' is larger than 20 g/m$^2$, a balance of the film and the Zr amount to be added afterwards deteriorates so that the film may have insufficient corrosion resistance.

According to this embodiment, the Zr-based phosphate compound film 14 (zirconium phosphate and zirconium hydrogen phosphate), which is disposed as the upper layer, is formed using a treatment liquid (a second treatment liquid) prepared by adding a Zr-based compound ($(NH_4)_2ZrF_6$, $ZrO(NO_3)_2$ and the like) to phosphoric acid, followed by mixing, dissolving and keeping the mixture warm with heating at around 40° C. to 90° C., more preferably around 70° C. to 90° C., and further preferably around 80° C. It is preferable that the molar ratio of Zr to P (Zr ion/P ion) in the treatment liquid be 0.1 to 1,000. It is preferable that the molar concentration of a Zr ion in the treatment liquid be 0.001 mol/L to 1 mol/L. As a method for forming the Zr-based phosphate compound film 14 on the zinc phosphate-based film 13', there is exemplified a method which includes dipping the underlying metal 12 on which the zinc phosphate-based film 13' is formed in advance in the second treatment liquid for about 1 to 20 minutes, more preferably about 1 to 5 minutes, and further preferably about 3 to 4 minutes. In order to have an effect on film formation efficiency and uniformity, it is permissible appropriately to stir the treatment liquid and oscillate the substrate.

As a result, the Zr-based phosphate compound film 14 is formed to cover a defective part in the under layer zinc phosphate-based film 13'. Therefore, as the barrier property is increased, the function of the film as a protective film having excellent corrosion resistance may be improved.

Though it depends on film forming conditions, the amount of the Zr-based phosphate compound film 14 required to improve a corrosion resistance effect due to barrier property of the Zr-based phosphate compound is preferably equal to or higher than 1 mg/m$^2$ in terms of the adhesion amount of Zr. When the amount of the Zr-based phosphate compound film 14 is equal to or more than 10 mg/m$^2$, it is possible to expect to have satisfactory corrosion resistance required for general use. When the amount of the Zr-based phosphate compound film 14 is equal to or more than 20 mg/m$^2$, it is possible to obtain sufficient corrosion resistance even under adverse conditions. In addition, when the film is thickened in the same manner as in the above-mentioned independent film, the adhesion of the film to the underlying metal 12, which is the substrate, may deteriorate. Therefore, it is preferable to set the upper limit of the adhesion amount of the Zr-based phosphate compound film 14 as 200 mg/m$^2$.

When the Zr-based compound, in particular, a fluorine compound such as $(NH_4)_2ZrF_6$, is subjected to a liquid-phase precipitation in an aqueous solution without adding phosphoric acid, a zirconium oxide is precipitated rather than the Zr-based phosphate compound such as zirconium phosphate. The zirconium oxide has a weaker affinity for the phosphate compound on the surface of the underlying metal and a poorer barrier property than the zirconium phosphate. Therefore, it is presumed that it is impossible to obtain the desired protective film function.

On the other hand, when an excess of phosphoric acid is added, the acidity of the treatment liquid is increased so that the zinc phosphate-based film 13' on the surface of the underlying metal 12 is dissolved, which is not preferable. It is permissible to form a lubricative film 15, which becomes the outermost layer, after the completion of formation of the Zr-based phosphate compound film 14, which is the upper layer. For the lubricative film 15, a generally used method for forming a lubricative film itself may be employed. Therefore, there is no need to set specific treatment conditions and it is possible to obtain the same lubricity and processability as usual. To be specific, the lubricative film 15, for example, may be a lubricative film formed by a lube treatment. To be more specific, a metal-soapy layer and an unreacted metal and soapy layer may be formed on the surface of a metal material by dipping the metal material in a sodium stearate solution. When the metal material is dipped in a lime soap solution, only an (unreacted) soapy layer is formed.

As mentioned above, it is possible to obtain a protective film which has the usual lubricity and significantly increased corrosion resistance.

Example 1

Hereinafter, Example 1 according to the first embodiment of the present invention will be described in detail. However, the invention is not limited to Example 1.

<Underlying Metal>

An S45C material having a size of ϕ25 mm×30 mm was used as an underlying metal. A zinc phosphate-based film was formed on the underlying metal by a bonderite treatment and the resulting material was used as a comparative material (sample 1) to evaluate Example of the present invention.

<Formation of Zinc Phosphate-Based Film Containing Zr-Based Phosphate Compound>

A treatment liquid in which a Zr-based compound, $(NH_4)_2ZrF_6$ or $ZrO(NO_3)_2$, and a bonderite treatment liquid were mixed and dissolved in the amount as shown in Table 1 was prepared. The treatment liquid was heated and kept warm at 80° C. and the above-mentioned underlying metal was dipped in the treatment liquid. In this manner, samples 2 to 19 in which a zinc phosphate-based film containing a Zr-based phosphate compound was formed on the underlying metal were prepared. The combination of the bonderite treatment and the treatment for forming the zinc phosphate-based film containing the Zr-based phosphate compound is as shown in Table 1. Since the sample 1 was only subjected to the bonderite treatment, it had a zinc phosphate-based film. The samples 2 to 13 were subjected to the bonderite treatment and then subjected to the treatment for forming the zinc phosphate-based film containing the Zr-based phosphate compound. Therefore, the samples had a zinc phosphate-based film containing a Zr-based phosphate compound on the surface thereof. The samples 14 to 19 were only subjected to treatment for forming the zinc phosphate-based film containing the Zr-based phosphate compound. Therefore, the samples had a zinc phosphate-based film containing a Zr-based phosphate compound directly on the underlying metal.

<Film Evaluation>

In order to calculate the amount of film formation, respective calibration curves of Zr and P representing the relationship between the fluorescent X-ray intensity and the adhesion amount were prepared. The fluorescent X-ray intensity of each sample was measured and the measurement result was compared with the calibration curves, thereby calculating the adhesion amount. The Zr concentration distribution in the depth direction was measured in accordance with GDS. An area from the surface of the phosphate compound-based film to a depth of 50% was defined based on an area where the P concentration became ½ of the P concentration in the outermost surface. For a GDS measurement, GD-PROFILER 2 manufactured by JOBIN YVON was used. Measurement conditions were set as high-frequency electricity of 35 W, under a 600 Pa argon atmosphere, analysis area of ϕ4 mm, a measuring time of 100 seconds, and a sampling time of 0.05 sec/point.

<Corrosion Resistance Evaluation>

Corrosion resistance was evaluated in accordance with a salt spray test (SST: JIS Z2371) at a test time of 1 hour, 3 hours and 6 hours. The results are shown in Table 1. In Table 1, VG represents that the sample was better than the base material (sample 1); and GOOD represents that the sample was equivalent to or better than the base material.

<Lubricity Evaluation>

Figure 3A:
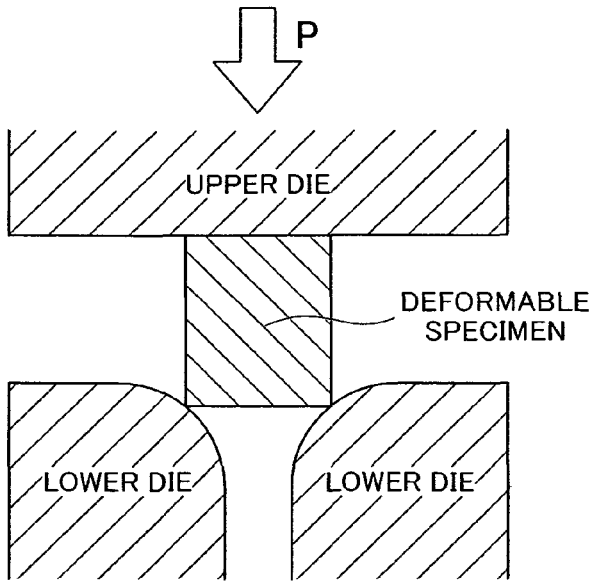
FIG. 3A is a view illustrating a state before molding pressure P is applied in a spike test used for evaluating lubricity.
Figure 3B:
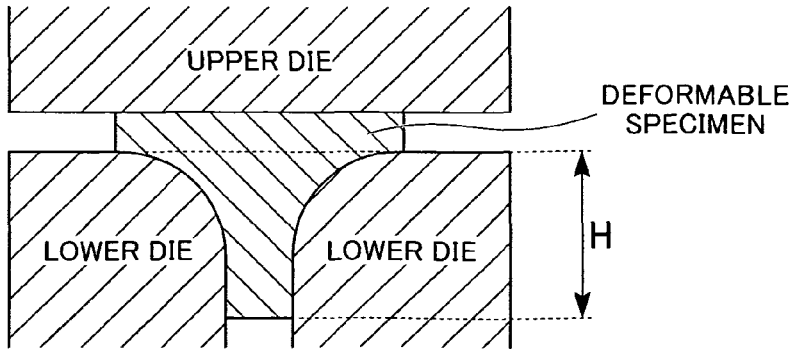
FIG. 3B is a view illustrating a state after molding pressure P is applied in a spike test used for evaluating lubricity.

The lubricity was evaluated in accordance with the well-known spike test. To be specific, as shown in FIG. 3A, molding pressure P was applied from an upper mold to a columnar sample. As a result, as shown in FIG. 3B, a spike portion was formed in the bottom of a specimen. On the basis of a height H of the formed spike, the lubricity was evaluated (as the height of the spike increases, it represents more excellent lubricity). The results are shown in Table 1. On the basis of the height H of the spike after the completion of the test and the molding pressure P, the lubricity was evaluated. In Table 1, GOOD represents that the lubricity of the sample is equivalent to or better than the base material (sample 1).

<Evaluation Result>

As shown in Table 1, with regard to the corrosion resistance, it was found that all the samples having the zinc phosphate based film containing the Zr-based phosphate compound had the corrosion resistance equivalent to or better than that of the base material (sample 1), thereby exhibiting extremely satisfactory corrosion resistance. In addition, regarding the lubricity, it was found that the lubricity did not deteriorate based on the result that the samples 2 to 19 had the lubricity equivalent to or better than that of the base material.

TABLE 1

| | Treatment 1 | | | | | Treatment 2 | | | | |
|---|---|---|---|---|---|---|---|---|---|---|
| | Treatment Liquid Composition | | | | | Treatment Liquid Composition | | | | |
| | Bonde-Treatment Liquid | Zr Source | | | Time | Bonde-Treatment Liquid | Zr Source | | | Time |
| Sample | (Proper) | $(NH_4)_2ZrF_6$ | $ZrO(NO_3)_2$ | Temp [° C.] | [min] | (Proper) | $(NH_4)_2ZrF_6$ | $ZrO(NO_3)_2$ | Temp [° C.] | [min] |
| 1 | Applied | — | — | 80 | 3.5 | Applied | — | — | 80 | 3.5 |
| 2 | Applied | — | — | 80 | 3.5 | Applied | — | — | 80 | 3.5 |
| 3 | Applied | — | — | 80 | 3.5 | Applied | — | — | 80 | 3.5 |
| 4 | Applied | — | — | 80 | 3.5 | Applied | — | — | 80 | 3.5 |
| 5 | Applied | — | — | 80 | 3.5 | Applied | — | — | 80 | 3.5 |

TABLE 1-continued

| | | | | | | | | | | |
|---|---|---|---|---|---|---|---|---|---|---|
| 6 | Applied | — | — | 80 | 3.5 | Applied | — | — | 80 | 3.5 |
| 7 | Applied | — | — | 80 | 3.5 | Applied | — | — | 80 | 3.5 |
| 8 | Applied | — | — | 80 | 3.5 | Applied | 0.001 | — | 80 | 3.5 |
| 9 | Applied | — | — | 80 | 3.5 | Applied | 0.01 | — | 80 | 3.5 |
| 10 | Applied | — | — | 80 | 3.5 | Applied | 0.1 | — | 80 | 3.5 |
| 11 | Applied | — | — | 80 | 3.5 | Applied | — | 0.001 | 80 | 3.5 |
| 12 | Applied | — | — | 80 | 3.5 | Applied | — | 0.01 | 80 | 3.5 |
| 13 | Applied | — | — | 80 | 3.5 | Applied | — | 0.1 | 80 | 3.5 |
| 14 | Applied | 0.001 | — | 80 | 3.5 | Applied | 0.001 | — | 80 | 3.5 |
| 15 | Applied | 0.01 | — | 80 | 3.5 | Applied | 0.01 | — | 80 | 3.5 |
| 16 | Applied | 0.1 | — | 80 | 3.5 | Applied | 0.1 | — | 80 | 3.5 |
| 17 | Applied | — | 0.001 | 80 | 3.5 | Applied | — | 0.001 | 80 | 3.5 |
| 18 | Applied | — | 0.01 | 80 | 3.5 | Applied | — | 0.01 | 80 | 3.5 |
| 19 | Applied | — | 0.1 | 80 | 3.5 | Applied | — | 0.1 | 80 | 3.5 |

| | Treatment 3 | | | | | Film Condition | | | | | | |
|---|---|---|---|---|---|---|---|---|---|---|---|---|
| | Treatment Liquid Composition | | | | | | Surface | | | | | |
| | Bonde- | | | | | Amount | layer | Amount | Evaluation | | | |
| | Treatment Liquid | Zr Source | | Temp | Time | of [Zr] mg/m$^2$ | 50% Zr75% | of [P] g/m$^2$ | Corrosion resistance | | | |
| Sample | (Proper) | $(NH_4)_2ZrF_6$ | $ZrO(NO_3)_2$ | [° C.] | [min] | in film | or more | in film | 3H | 6H | Lubricity | Remark |
| 1 | — | — | — | — | — | 0 | — | 8 | — | — | — | Comp. Ex. |
| 2 | Applied | 0.001 | — | 80 | 3.5 | 13 | OK | 7 | VG | VG | GOOD | Ex. 1 |
| 3 | Applied | 0.01 | — | 80 | 3.5 | 17 | OK | 6 | VG | VG | GOOD | Ex. 1 |
| 4 | Applied | 0.1 | — | 80 | 3.5 | 50 | OK | 7 | VG | VG | GOOD | Ex. 1 |
| 5 | Applied | — | 0.001 | 80 | 3.5 | 2 | OK | 7 | VG | VG | GOOD | Ex. 1 |
| 6 | Applied | — | 0.01 | 80 | 3.5 | 29 | OK | 6 | VG | VG | GOOD | Ex. 1 |
| 7 | Applied | — | 0.1 | 80 | 3.5 | 261 | OK | 2 | VG | GOOD | GOOD | Ex. 1 |
| 8 | — | — | — | — | — | 1 | OK | 8 | VG | VG | GOOD | Ex. 1 |
| 9 | — | — | — | — | — | 8 | OK | 9 | VG | VG | GOOD | Ex. 1 |
| 10 | — | — | — | — | — | 10 | OK | 6 | VG | VG | GOOD | Ex. 1 |
| 11 | — | — | — | — | — | 1 | OK | 5 | VG | VG | GOOD | Ex. 1 |
| 12 | — | — | — | — | — | 4 | OK | 4 | VG | VG | GOOD | Ex. 1 |
| 13 | — | — | — | — | — | 10 | OK | 2 | VG | VG | GOOD | Ex. 1 |
| 14 | — | — | — | — | — | 4 | — | 7 | VG | GOOD | GOOD | Ex. 1 |
| 15 | — | — | — | — | — | 31 | — | 13 | VG | GOOD | GOOD | Ex. 1 |
| 16 | — | — | — | — | — | 87 | — | 19 | VG | GOOD | GOOD | Ex. 1 |
| 17 | — | — | — | — | — | 3 | — | 4 | VG | GOOD | GOOD | Ex. 1 |
| 18 | — | — | — | — | — | 3 | — | 4 | VG | GOOD | GOOD | Ex. 1 |
| 19 | — | — | — | — | — | 2 | — | 1 | VG | GOOD | GOOD | Ex. 1 |

Example 2

Hereinafter, Example 2 according to the second embodiment of the present invention will be described in detail. However, the invention is not limited to Example 2.

<Underlying Metal>

An S45C material having a size of ϕ25 mm×30 mm was used as an underlying metal. A zinc phosphate-based film was formed on the underlying metal by a bonderite treatment and the resulting material was used as a comparative material (sample 1) to evaluate Example of the present invention.

<Formation of Zr-Based Phosphate Compound Film and Zr Oxide Film>

A treatment liquid in which a Zr-based compound ($(NH_4)_2ZrF_6$ or $ZrO(NO_3)_2$) was dissolved in the amount as shown in Table 2 was prepared. The treatment liquid was heated and kept warm at 80° C. and the above-mentioned underlying metal was dipped in the treatment liquid to form Zr oxide films (samples 2, 7, 10, 15, 18 and 21). A treatment liquid in which a Zr-based compound ($(NH_4)_2ZrF_6$ or $ZrO(NO_3)_2$) and phosphoric acid were mixed and dissolved in the amount as shown in Table 2 was prepared. The treatment liquid was heated and kept warm at 80° C. and the above-mentioned underlying metal was dipped in the treatment liquid to form Zr-containing phosphate compound-based films (samples 3 to 6, 8, 9, 11 to 14, 16, 17, 19, 20, 22 and 23). The combination of the bonderite treatment and the above-mentioned treatment is as shown in Table 2. As a result, there were prepared a zinc phosphate-containing film material which was only subjected to the bonderite treatment as usual; samples which were subjected to the bonderite treatment and then subjected to the above-mentioned treatment and in which the under layer was zinc phosphate and the upper layer was a Zr oxide film; and samples which were subjected to the bonderite treatment and then subjected to the above-mentioned treatment and in which the under layer was zinc phosphate and the upper layer was a Zr-based phosphate compound film.

<Film Evaluation>

For the amount of film formation, respective calibration curves of Zr and P representing the relationship between the fluorescent X-ray intensity and the adhesion amount were prepared. The fluorescent X-ray intensity of each sample was measured, thereby calculating the adhesion amount.

<Corrosion Resistance Evaluation>

Corrosion resistance was evaluated in accordance with a salt spray test (SST: JIS Z2371) at a test time of 1 hour, 3 hours and 6 hours. The results are shown in Table 2. In Table 2, VG represents that the sample was better than the base material (standard 1); GOOD represents that the sample was equivalent to or better than the base material; and POOR represents that the sample was worse than the base material.

<Lubricity Evaluation>

The lubricity was evaluated in accordance with the well known spike test. To be specific, as shown in FIG. 3A, molding pressure P was applied from an upper mold to a columnar specimen. As a result, as shown in FIG. 3B, a spike portion was formed in the bottom of a specimen. On the basis of a height H of the formed spike, the lubricity was evaluated (as the height of the spike increases, it represents the more excellent lubricity). The results are shown in Table 2. On the basis of the height H of the spike after the completion of the test and the molding pressure P, the lubricity was evaluated. The samples which have lubricity worse than the base material (sample 1) were represented as POOR and the samples which have lubricity equivalent to or better than the base material were represented as GOOD.

<Evaluation Result>

As shown in Table 2, it is found that all the samples having the Zr-based phosphate compound film on zinc phosphate have the corrosion resistance equivalent to or better than that of the base material (sample 1), thereby exhibiting extremely satisfactory corrosion resistance. In addition, regarding the lubricity, it is found that the lubricity does not deteriorate based on the result that all the samples have the lubricity equivalent to or better than that of the base material.

TABLE 2

| | Treatment 1 | | | Treatment 2 | | | Treatment 3 | | | | |
|---|---|---|---|---|---|---|---|---|---|---|---|
| | Treatment Liquid Comp. Bonde Treatment | | | Treatment Liquid Comp. Bonde-Treatment | | | Treatment Liquid Composition | | | | |
| | | | | | | | Zr Source | | P Source | | |
| Sample | Liquid (Proper) | Temp [° C.] | Time [min] | Liquid (Proper) | Temp [° C.] | Time [min] | $(NH_4)_2ZrF_6$ | $ZrO(NO_3)_2$ | $H_3PO_4$(M) | Temp [° C.] | Time [min] |
| 1 | Applied | 80 | 3.5 | Applied | 80 | 3.5 | — | — | — | — | — |
| 2 | Applied | 80 | 3.5 | Applied | 80 | 3.5 | 0.001 | — | 0 | 80 | 3.5 |
| 3 | Applied | 80 | 3.5 | Applied | 80 | 3.5 | 0.001 | — | 0.001 | 80 | 3.5 |
| 4 | Applied | 80 | 3.5 | Applied | 80 | 3.5 | 0.001 | — | 0.01 | 80 | 3.5 |
| 5 | Applied | 80 | 7 | Applied | 80 | 7 | 0.001 | — | 0.01 | 80 | 3.5 |
| 6 | Applied | 80 | 7 | Applied | 80 | 10.5 | 0.001 | — | 0.01 | 80 | 3.5 |
| 7 | Applied | 80 | 3.5 | Applied | 80 | 3.5 | 0.01 | — | 0 | 80 | 3.5 |
| 8 | Applied | 80 | 3.5 | Applied | 80 | 3.5 | 0.01 | — | 0.001 | 80 | 3.5 |
| 9 | Applied | 80 | 3.5 | Applied | 80 | 3.5 | 0.01 | — | 0.01 | 80 | 3.5 |
| 10 | Applied | 80 | 3.5 | Applied | 80 | 3.5 | 0.1 | — | 0 | 80 | 3.5 |
| 11 | Applied | 80 | 3.5 | Applied | 80 | 3.5 | 0.1 | — | 0.001 | 80 | 3.5 |
| 12 | Applied | 80 | 3.5 | Applied | 80 | 3.5 | 0.1 | — | 0.01 | 80 | 3.5 |
| 13 | Applied | 80 | 3.5 | Applied | 80 | 3.5 | 1 | — | 0.001 | 80 | 3.5 |
| 14 | Applied | 80 | 3.5 | Applied | 80 | 3.5 | 1 | — | 0.01 | 80 | 3.5 |
| 15 | Applied | 80 | 3.5 | Applied | 80 | 3.5 | — | 0.001 | 0 | 80 | 3.5 |
| 16 | Applied | 80 | 3.5 | Applied | 80 | 3.5 | — | 0.001 | 0.001 | 80 | 3.5 |
| 17 | Applied | 80 | 3.5 | Applied | 80 | 3.5 | — | 0.001 | 0.01 | 80 | 3.5 |
| 18 | Applied | 80 | 3.5 | Applied | 80 | 3.5 | — | 0.01 | 0 | 80 | 3.5 |
| 19 | Applied | 80 | 3.5 | Applied | 80 | 3.5 | — | 0.01 | 0.001 | 80 | 3.5 |
| 20 | Applied | 80 | 3.5 | Applied | 80 | 3.5 | — | 0.01 | 0.01 | 80 | 3.5 |
| 21 | Applied | 80 | 3.5 | Applied | 80 | 3.5 | — | 0.1 | 0 | 80 | 3.5 |
| 22 | Applied | 80 | 3.5 | Applied | 80 | 3.5 | — | 0.1 | 0.001 | 80 | 3.5 |
| 23 | Applied | 80 | 3.5 | Applied | 80 | 3.5 | — | 0.1 | 0.01 | 80 | 3.5 |

| | | | Evaluation | | | |
|---|---|---|---|---|---|---|
| | | | Corrosion resistance | | | |
| Sample | Amount of [Zr] $mg/m^2$ in film | Amount of [P] $g/m^2$ in underlayer film | 3H | 6H | Lubricity | Remark |
| 1 | 0 | 8 | — | — | — | Comp. Ex. |
| 2 | 8 | 7 | POOR | POOR | GOOD | Comp. Ex. |
| 3 | 13 | 7 | VG | VG | GOOD | Ex. 2 |
| 4 | 12 | 7 | VG | VG | GOOD | Ex. 2 |
| 5 | 12 | 20 | VG | VG | GOOD | Ex. 2 |
| 6 | 12 | 30 | GOOD | GOOD | GOOD | Comp. Ex. |
| 7 | 20 | 9 | POOR | POOR | GOOD | Comp. Ex. |
| 8 | 28 | 5 | VG | VG | GOOD | Ex. 2 |
| 9 | 18 | 6 | VG | VG | GOOD | Ex. 2 |
| 10 | 6 | 6 | POOR | POOR | GOOD | Comp. Ex. |
| 11 | 42 | 5 | VG | VG | GOOD | Ex. 2 |
| 12 | 46 | 7 | VG | VG | GOOD | Ex. 2 |
| 13 | 200 | 7 | VG | VG | GOOD | Ex. 2 |
| 14 | 250 | 7 | GOOD | GOOD | GOOD | Comp. Ex. |
| 15 | 54 | 5 | POOR | POOR | GOOD | Comp. Ex. |
| 16 | 3 | 8 | VG | VG | GOOD | Ex. 2 |
| 17 | 1 | 14 | VG | VG | GOOD | Ex. 2 |
| 18 | 2 | 5 | POOR | POOR | GOOD | Comp. Ex. |

TABLE 2-continued

| | | | | | | |
|---|---|---|---|---|---|---|
| 19 | 1 | 8 | VG | VG | GOOD | Ex. 2 |
| 20 | 33 | 16 | VG | VG | GOOD | Ex. 2 |
| 21 | 152 | 1 | POOR | POOR | GOOD | Comp. Ex. |
| 22 | 626 | 2 | VG | GOOD | GOOD | Comp. Ex. |
| 23 | 248 | 22 | GOOD | GOOD | GOOD | Comp. Ex. |

As mentioned above, according to the present invention, it is possible to form a strong protective film having high corrosion resistance while sustaining existing lubricity without greatly changing the usual materials and processes.

Therefore, it is possible to obtain stable quality and processability without incurring corrosion and rust even when a metal material is under adverse conditions, such as adhesion of washing liquid after the completion of acid washing and alkaline washing during a wire drawing process and a drawing process of a metal material, and environmental changes occurring in transit.

INDUSTRIAL APPLICABILITY

The present invention greatly contributes not only to the metal-processing industry but also to the metal materials industry such as the steel industry.

BRIEF DESCRIPTION OF THE REFERENCE SYMBOLS

1: METAL MATERIALS
2: UNDERLYING METAL
3: PHOSPHATE COMPOUND-BASED FILM
3': ZINC PHOSPHATE-BASED FILM
3*a*: Zr-BASED PHOSPHATE COMPOUND
5: LUBRICATIVE FILM
11: METAL MATERIALS
12: UNDERLYING METAL
13: PHOSPHATE COMPOUND-BASED FILM (UNDER LAYER FILM)
13': ZINC PHOSPHATE-BASED FILM
14: Zr-BASED PHOSPHATE COMPOUND FILM (UPPER LAYER FILM)
15: LUBRICATIVE FILM
P: MOLDING PRESSURE

The invention claimed is:

1. A metal material comprising:
an underlying metal; and
a phosphate compound-based film which is disposed on a surface of the underlying metal and has a surface part,
wherein the phosphate compound-based film consists of a phosphate matrix of one or more of zinc phosphate, zinc-ferrous phosphate, calcium phosphate, and iron phosphate, and a Zr phosphate and a Zr hydrogen phosphate dispersed in the phosphate matrix, and the surface part of the phosphate compound-based film contains Zr.

2. The metal material according to claim 1,
wherein the phosphate compound-based film contains Zr in an amount equal to or more than 1 $mg/m^2$.

3. The metal material according to claim 1,
wherein the phosphate matrix of the phosphate compound-based film is mainly zinc phosphate.

4. The metal material according to claim 1,
wherein an amount equal to or more than 75% by mass of Zr contained in the phosphate compound-based film exists in an area from the surface to a depth of 50% in a thickness direction of the phosphate compound-based film.

5. The metal material according to claim 1,
wherein an amount of the phosphate compound-based film is equal to or more than 1 $g/m^2$ and equal to or less than 20 $g/m^2$ in terms of P.

6. The metal material according to claim 1 further comprising:
a lubricative film disposed on the phosphate compound-based film.

7. The metal material according to claim 1, wherein a main component of the surface of the underlying metal is iron.

8. A metal material comprising:
an underlying metal;
a phosphate compound-based film disposed on a surface of the underlying metal; and
a Zr phosphate film disposed on a surface of the phosphate compound-based film,
wherein the Zr phosphate film consists of a Zr phosphate and a Zr hydrogen phosphate,
an amount of the Zr phosphate film is equal to or more than 1 $mg/m^2$ and equal to or less than 200 $mg/m^2$ in terms of Zr, and
the phosphate compound-based film is a zinc phosphate film.

9. The metal material according to claim 8,
wherein an amount of the phosphate compound-based film is equal to or more than 1 $g/m^2$ and equal to or less than 20 $g/m^2$ in terms of P.

10. The metal material according to claim 8 further comprising:
a lubricative film disposed on the Zr phosphate film.

11. The metal material according to claim 8, wherein a main component of the surface of the underlying metal is iron.

* * * * *